US009845955B1

(12) United States Patent
Villarreal

(10) Patent No.: US 9,845,955 B1
(45) Date of Patent: Dec. 19, 2017

(54) LIGHTER DEVICE

(71) Applicant: Edmund D. Villarreal, Raleigh, NC (US)

(72) Inventor: Edmund D. Villarreal, Raleigh, NC (US)

( * ) Notice: Subject to any disclaimer, the term of this patent is extended or adjusted under 35 U.S.C. 154(b) by 605 days.

(21) Appl. No.: 13/941,516

(22) Filed: Jul. 14, 2013

Related U.S. Application Data

(60) Provisional application No. 61/672,019, filed on Jul. 16, 2012.

(51) Int. Cl.
*F23Q 2/32* (2006.01)
*F23Q 1/06* (2006.01)
*F23Q 13/00* (2006.01)

(52) U.S. Cl.
CPC ..... *F23Q 2/32* (2013.01); *F23Q 1/06* (2013.01); *F23Q 13/00* (2013.01)

(58) Field of Classification Search
CPC ..... F23Q 2/32; F23Q 2/36
USPC ..... 431/253
See application file for complete search history.

(56) References Cited

U.S. PATENT DOCUMENTS 1,619,212 A * 3/1927 Neederman ..... A46B 15/0055 132/309
2,052,689 A * 9/1936 Aronson ..... F23Q 2/36 206/457
2,651,106 A * 9/1953 Breitzke ..... B26B 3/06 30/125
3,544,253 A * 12/1970 Bloom ..... F23Q 2/32 33/354
4,526,371 A * 7/1985 Venditti ..... A45C 15/00 235/79
4,698,068 A * 10/1987 Jensen ..... C10L 11/00 431/269
4,770,669 A * 9/1988 Allen ..... C10L 11/00 44/510
4,931,015 A * 6/1990 Amadei ..... A61B 1/253 433/30
5,218,978 A * 6/1993 Yang ..... A45D 42/02 132/296
6,207,729 B1 * 3/2001 Medoff ..... A01N 25/34 111/200
6,640,445 B1 * 11/2003 Crawford ..... B26B 7/00 30/277.4
7,623,341 B1 * 11/2009 Salvat ..... G06F 1/1607 345/905
8,186,995 B2 * 5/2012 Putrello, Jr. ..... F23Q 1/02 148/401
2002/0184771 A1 * 12/2002 Kaufer ..... B26B 13/22 30/125
2004/0118503 A1 * 6/2004 Record ..... F41H 3/00 156/85

(Continued)

*Primary Examiner* — Jason Lau
(74) *Attorney, Agent, or Firm* — NK Patent Law, PLLC

(57) ABSTRACT

A lighter device (10) is provided having a handle (12), an ignitable material (14) carried by the handle, a striker material (16) for igniting the ignitable material (14), and a mirror (20) selectively carried by the handle. The mirror (20) can be slideably removable and can be reinserted into the handle of the lighter device (10), allowing for a person to use the mirror (20) as a signaling device. The mirror (20) can be bendable to form a reflective parabolic surface. The handle (12) of the lighter device (10) can be made of a combustible material that can be used to light a fire in wet conditions.

25 Claims, 7 Drawing Sheets

(56) References Cited

U.S. PATENT DOCUMENTS

| | | | | |
|---|---|---|---|---|
| 2004/0174700 | A1* | 9/2004 | Zirk | B26B 1/04 362/119 |
| 2007/0009845 | A1* | 1/2007 | Xu | F23Q 2/32 431/253 |
| 2010/0050690 | A1* | 3/2010 | Woodward | A44C 5/0007 63/15.1 |
| 2013/0022933 | A1* | 1/2013 | Beard | F23Q 2/36 431/253 |
| 2014/0120481 | A1* | 5/2014 | Buchbinder | F23Q 2/32 431/131 |

* cited by examiner

LIGHTER DEVICE

CROSS-REFERENCE TO RELATED APPLICATIONS

This application claims the benefit of U.S. Provisional Application No. 61/672,019, filed Jul. 16, 2012; which is incorporated herein by reference in its entirety.

TECHNICAL FIELD

This disclosure is related to a lighter device having a mirror, and more particularly, towards a lighter device having a selectively removable mirror.

BACKGROUND

Along with shelter and water, fire is the most important thing you need to survive in the wilderness. It provides the following: warmth in cold conditions; a means to purify water or sterilize tools; heat to dry wet clothes; a cooking flame; a sense of security and comfort; smoke for rescue signals; heat to melt snow and ice for drinking water; a means to scare away dangerous animals; light for your shelter or for torches; and smoke to help repel insects. While there are many methods to start a fire without a match, they all require a bit of practice. Thus, the safest method is to be prepared with a lighter device.

While there are many lighter devices available, there is a need for a single lighter device that can provide multiple additional functions, such as providing combustible material for starting a fire even in the wettest of conditions and a mechanism for signaling in times of distress.

Accordingly, such a multi-functional lighter device is provided in the present disclosure.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Disclosed herein is a lighter device (10). The lighter device (10) includes a handle (12), an ignitable material (14) carried by the handle, a striker material (16) for igniting the ignitable material (14), and a mirror (20) selectively carried by the handle.

According to one or more embodiments, the handle defines a recess (22) that selectively receives a mirror holder (24). The mirror (20) can be slideably received in the mirror holder (24). The handle (12) can define a slidejoint (226) that selectively receives the mirror (20). The mirror (20) can be slideably received in the slidejoint (226). The lighter device mirror (20) can be bendable to form a reflective parabolic surface that is advantageous for a user to generate a signal.

According to one or more embodiments, the lighter device striker material (16) is carried by the ignitable material (14). The striker material (16) can extend along a length of the ignitable material (14).

According to one or more embodiments, the lighter device ignitable material (14) comprises magnesium. The magnesium can include one or more dopants and/or colorants for burning hotter and effectuating colored flames. According to one or more embodiments, the lighter device dopants and/or colorants include one or more of iron, phosphorus, barium, calcium salts, copper compounds, or strontium salts.

According to one or more embodiments, the lighter device further includes a striker bar (30) for striking the striker material (16). According to one or more embodiments, the striker bar (30) is configured for removing portions of the ignitable material (14) to thereby form shavings that are useful for starting a fire. The lighter device is useful for starting a fire under wet conditions and when the lighter device itself is wet.

According to one or more embodiments, the lighter device striker material (16) comprises a flint material having one or more dopants and/or colorants for effectuating colored sparks. The dopants and/or colorants can include one or more of iron, phosphorus, barium, calcium salts, copper compounds, or strontium salts.

According to one or more embodiments, the lighter device handle (12) includes a wood, composite, or polymer material. According to one or more embodiments, the wood, composite, or polymer material is combustible. According to one or more embodiments, the handle (12) includes wood coated with a flammable material. According to one or more embodiments, the flammable material coated on the wood can be a lacquer. According to one or more embodiments, the handle (12) can define a pattern. According to one or more embodiments, the handle (12) can define a camouflage design.

According to one or more embodiments, the striker bar (30) can be configured for removing portions of the combustible handle material (12) to thereby form shavings that are useful for starting a fire. The lighter device can be useful for starting a fire under wet conditions and when the lighter device itself is wet.

According to one or more embodiments, the lighter device (10) further includes a compass (32).

According to one or more embodiments, the handle (212) of the lighter device defines a cavity (238) for storing one or more items. According to one or more embodiments, the lighter device further comprises a cap (236) for enclosing the cavity (238). According to one or more embodiments, the cap includes a compass (32). According to one or more embodiments, the compass (32) glows in the dark.

According to one or more embodiments, the lighter device (10) can be buoyant in a host liquid. According to one or more embodiments, the lighter device (10) can be buoyant in water.

BRIEF DESCRIPTION OF THE DRAWINGS

The foregoing summary, as well as the following detailed description of various embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

The presently disclosed invention is described with specificity to meet statutory requirements. However, the description itself is not intended to limit the scope of this patent. Rather, the inventor has contemplated that the claimed invention might also be embodied in other ways, to include different steps or elements similar to the ones described in this document, in conjunction with other present or future technologies.

Figure 1A:
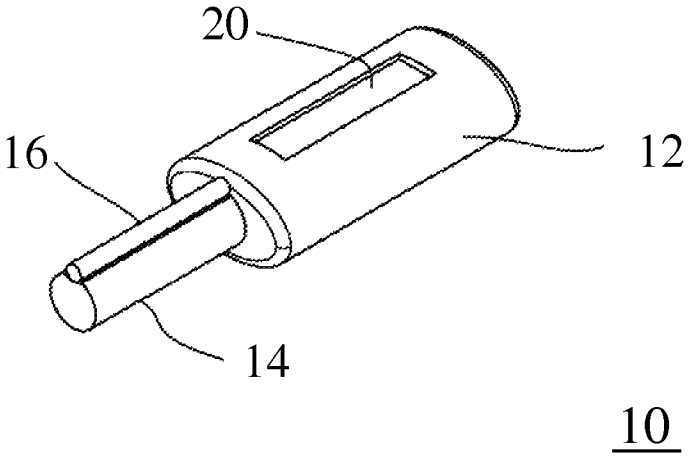
FIG. 1A is a perspective view of an example of a lighter device in accordance with embodiments of the present disclosure.
Figure 1B:
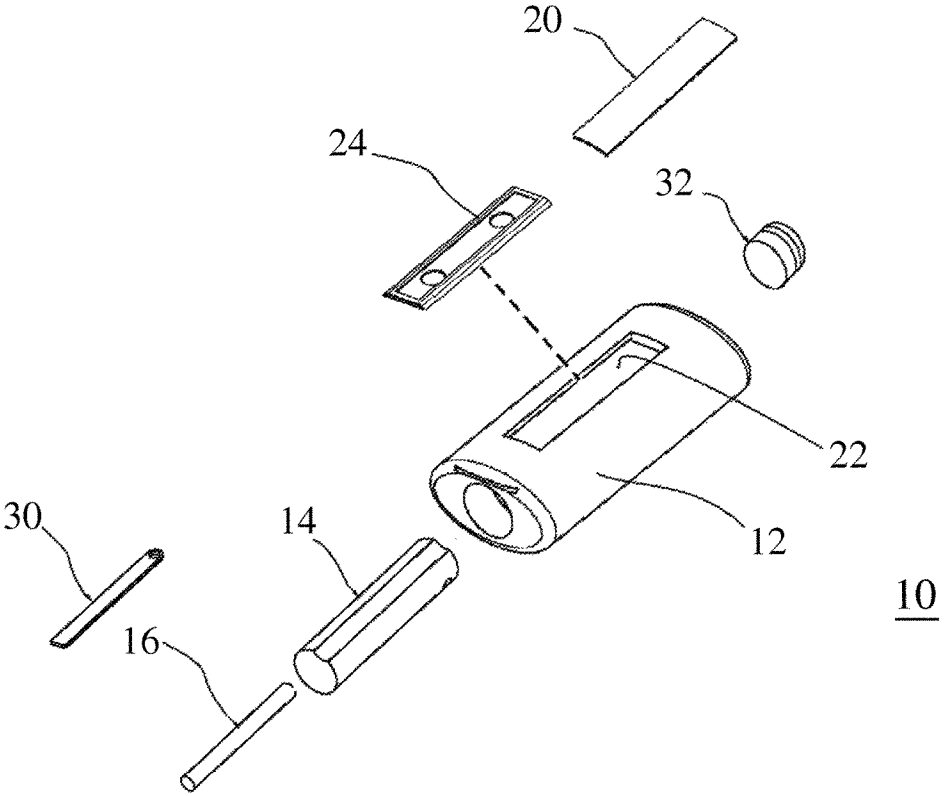
FIG. 1B is an exploded view of FIG. 1A.

FIG. 1A illustrates an example of a lighter device (10) having a mirror in accordance with embodiments of the present disclosure. FIG. 1B illustrates an exploded view of the lighter device (10) of FIG. 1A. FIG. 1B illustrates the example of the lighter device (10) including a handle (12), an ignitable material (14) carried by the handle, a striker material (16) for igniting the ignitable material, and a mirror (20) selectively carried by the handle.

Figure 4:
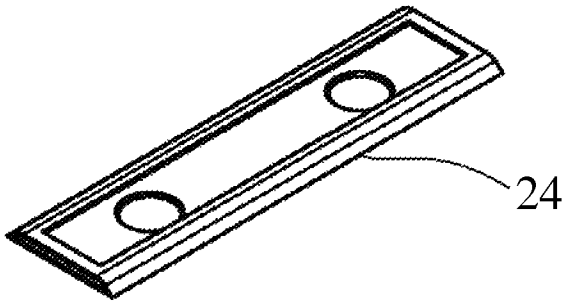
FIG. 4 is a perspective view of a mirror holder in accordance with embodiments of the present disclosure.

According to one or more embodiments, the handle (12) defines a recess (22) that selectively receives a mirror holder (24). The mirror holder (24) can be secured to the handle (12) such as by using screws or a bonding agent. The mirror (20) can be slideably received in the mirror holder (24). FIG. 4 is a perspective view of a mirror holder (24) in accordance with embodiments of the present disclosure. Accordingly, the mirror (20) can be slideably removed and reinserted into the mirror holder (24), for example, to enable a person to use the mirror as a signaling device. The mirror can be bendable to form a reflective parabolic surface that is even better than a flat mirror to serve as a signaling device.

According to one or more embodiments, the lighter device striker material (16) is carried by the ignitable material (14). The striker material (16) can extend along a length of the ignitable material (14). The lighter device (10) can include a striker bar (30) for striking the striker material (16). Striking the striker material (16) with the striker bar (30) can effectuate a shower of sparks. The sparks are advantageous to a user for generating a signal such as, for example, to generate a signal in times of distress.

According to one or more embodiments, the lighter device striker material (16) includes a flint material. Striking the striker material including a flint material (16) with the striker bar (30) can effectuate a shower of sparks. The flint material can include about 50% to about 70% cerium, about 20% to about 30% iron, about 0% to about 30% lanthanum, and one or more of zinc, silicon, tungsten, copper, or magnesium in small or trace quantities. In another embodiment, the flint material can include a larger percentage of magnesium. For example, the flint material can include about 50% to about 70% cerium, about 20% to about 30% iron, about 5% to about 30% lanthanum, about 2.5% to about 20% magnesium, and one or more of zinc, silicon, tungsten, or copper in small or trace quantities. The larger percentage of magnesium in the flint can increase the temperature of the effectuated sparks. In addition, the magnesium can burn even when wet. Thus, striking the striker material that includes magnesium (16) with the striker bar (30) can effectuate a shower of sparks at an increased temperature. Further, striking the striker material that includes magnesium (16) with the striker bar (30) can effectuate a shower of sparks capable of effectuating a flame when positioned in the presence of a suitable flammable material even in wet conditions.

According to one or more embodiments, the flint material can include one or more dopants and/or colorants for effectuating colored sparks. The dopants and/or colorants can include one or more of iron, phosphorus, barium, calcium salts, copper compounds, or strontium salts and the dopants are including in the flint material to effectuate colored sparks. For example, phosphorus burns spontaneously in air and causes glow-in-the-dark effects. Barium creates green colors in the sparks. Calcium salts produce orange color in the sparks. Copper compounds produce blue colors in the sparks. Strontium salts impart a red color to the sparks. Iron is used to produce sparks, and the heat of the metal flint determines the color of the sparks. Thus, the flint material can include one or more dopants and/or colorants for effectuating colored sparks such as, for example, glow-in-the-dark sparks, green sparks, blue sparks, red sparks, yellow sparks, or white sparks, or the sparks can be a combination of one or more of these colored sparks.

Striking the striker material (16) with the striker bar (30) can effectuate a shower of sparks capable of effectuating a flame when positioned in the presence of any suitable flammable material. For example, the striker bar (30) can be configured for removing portions of the ignitable material (14) that is carried by the lighter device handle (12) to thereby form shavings of the ignitable material. Striking the striker material (16) with the striker bar (30) in the vicinity of the ignitable material shavings can cause the ignitable material shavings to burn. The ignitable material shavings can be burned regardless of whether the ignitable material shavings are wet. Thus, an advantage of the lighter device is that it is useful for starting a fire under wet conditions and when the lighter device itself is wet.

According to one or more embodiments, the lighter device ignitable material (14) can include magnesium. The ignitable material (14) can include a magnesium rod. The magnesium or magnesium rod can include one or more dopants and/or colorants for burning hotter and effectuating colored flames. The lighter device dopants and/or colorants can include one or more of iron, phosphorus, barium, calcium salts, copper compounds, or strontium salts. For example, phosphorus burns spontaneously in air and causes the flames to possess glow-in-the-dark effects. Barium creates green colors in the flames. Calcium salts produce orange color in the flames. Copper compounds produce blue colors in the flames. Strontium salts impart a red color to the flames. Iron is used to produce sparks, and the heat of the magnesium determines the color of the flames. Thus, the ignitable material can include one or more dopants and/or colorants for effectuating colored flames such as, for example, glow-in-the-dark flames, green flames, blue flames, red flames, yellow flames, or white flames, or the flames can be a combination of one or more of these colored flames.

According to one or more embodiments, the lighter device (10) further includes a compass (32). The compass (32) can glow in the dark.

According to one or more embodiments, the lighter device handle (12) includes a wood, composite, or polymer material. The wood, composite, or polymer material can be combustible. The handle can include a wood coated with a flammable material. The flammable material coated on the wood can be a lacquer. The striker bar (30) of the lighter device (10) can be configured for removing portions of the combustible handle (12) to thereby form shavings of the combustible handle. Striking the striker material (16) with the striker bar (30) can effectuate a shower of sparks capable of effectuating a flame when positioned in the presence of the shavings of the combustible handle. Striking the striker material (16) with the striker bar (30) in the vicinity of the shavings of the combustible handle can cause the shavings to burn. The combustible handle shavings can be burned regardless of whether the combustible handle shavings are wet. Thus, an advantage of the lighter device (10) is that it is useful for starting a fire under wet conditions and when the lighter device (10) itself is wet.

According to one or more embodiments, the lighter device (10) is buoyant in a host liquid. The lighter device (10) can be buoyant in water.

The composite combustible material of the present disclosure can be any composite material that is able to catch fire and burn easily. For example, the composite combustible material can include compressed wood particles and a binder that will act as a bonding agent to bind the wood particles together. In one embodiment, the composite combustible material can be a lignocellulosic material and a binder that is a thermosetting resin. In one embodiment, the composite combustible material can include paraffin (petroleum-based wax) or bio-wax. In one embodiment, the lignocellulosic material can include waste fiber from oil palm, fiber from cotton plants, waste wax-cardboard such as that used in the packing of perishable foods for shipment, commercial wood waste from manufacturers, or waste agricultural biomass (nut shells, fruit pits, etc.). In one embodiment, the composite combustible material is DURAFLAME or MAGIC IGNITER fatwood.

According to one or more embodiments, the combustible handle (12) is produced with a combustible material like wood, a lignocellulosic material as described above, DURAFLAME, or MAGIC IGNITER fatwood. The combustible handle (12) is produced by grinding the wood or lignocellulosic material or DURAFLAME or MAGIC IGNITER fatwood into a pulp, or fine small shavings, or fine small particles. Next, a combustible resin or glue is added that will act as a bonding agent to hold the material together (the "binder") and the ingredients are mixed together. The material is placed into a pre-made mold for the handle (12) and molded under a high capacity press machine (HCPM). The handle is removed and set aside to harden/cure. The handle is sanded to remove any rough edges and/or "splinters".

According to one or more embodiments, an aperture can be drilled through the combustible handle (12) about an inch to an inch and a half from the bottom. The aperture allows for a cord/lanyard to go through this aperture to attach the striker bar (30). According to one or more embodiments, the aperature is countersinked on both sides. The combustible handle (12) is then drilled at the top to carry the ignitable material (14). The ignitable material can include magnesium. The ignitable material (14) can include a magnesium rod.

Figure 5:
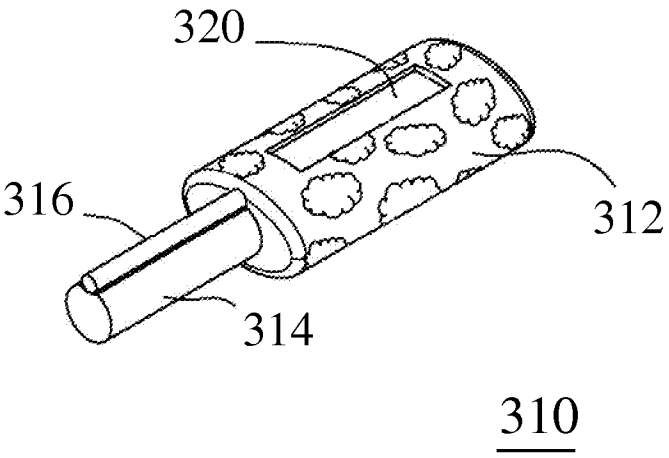
FIG. 5 is a perspective view of an example of a lighter device wherein the handle defines a pattern in accordance with embodiments of the present disclosure.

According to one or more embodiments, the combustible handle (12) can define a pattern. One process for defining the pattern can encompasses a procedure called hydro-dripping or hydro graphics or water transfer printing. The handle pattern can define a camouflage design. FIG. 5 illustrates an example of a lighter device (310) having a handle defining a pattern in accordance with embodiments of the present disclosure.

Figure 2:
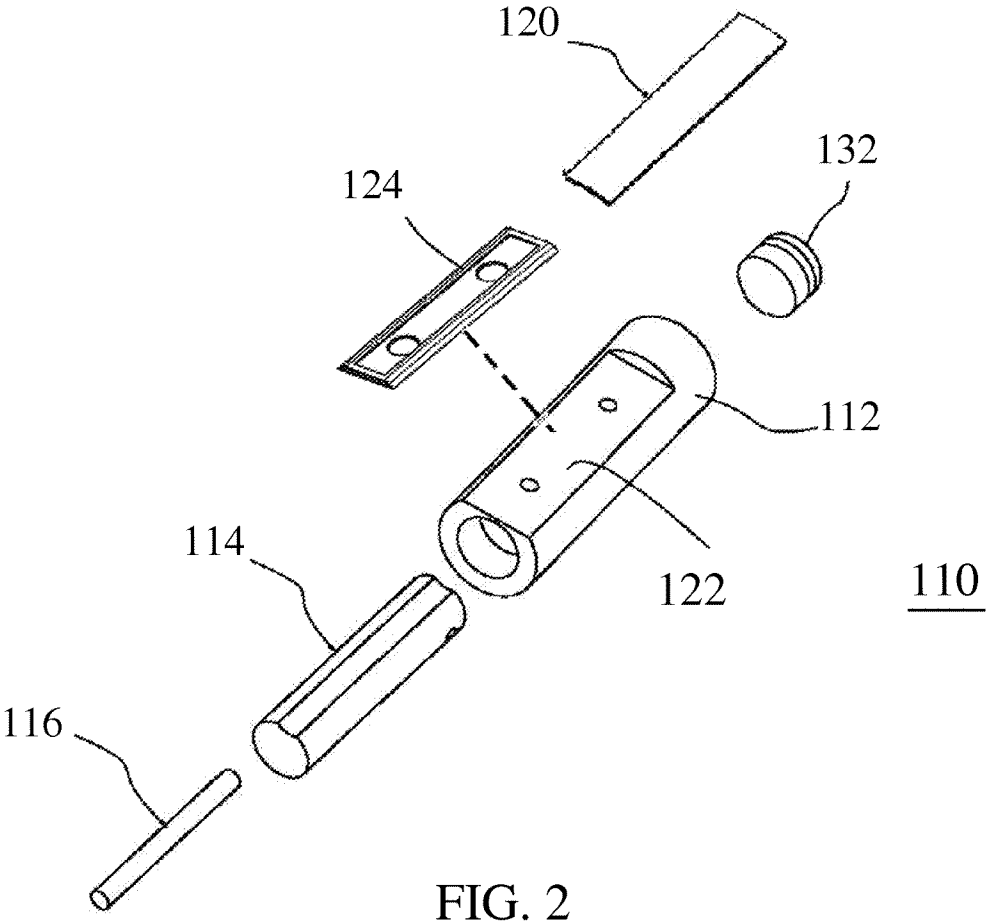
FIG. 2 is an exploded view of an example of a lighter device having a wooden handle in accordance with embodiments of the present disclosure.

FIG. 2 illustrates an example of a lighter device (110) having a mirror in accordance with embodiments of the present disclosure, wherein the handle (112) includes wood. FIG. 2 illustrates an exploded view of the example of lighter device (110) comprising a wood handle (112) defining a recess (122) that selectively receives a mirror holder (124); an ignitable material (114) carried by the handle (112); a striker material (116) for igniting the ignitable material (114), the striker material extending along a length of the ignitable material (114); and a mirror (120) slideably received in the mirror holder (124). Accordingly, the mirror (120) can be slideably removed and reinserted into the mirror holder (124), for example, to enable a person to use the mirror (120) as a signaling device. The mirror (120) can be bendable to form a reflective parabolic surface that is even better than a flat mirror to serve as a signaling device.

According to one or more embodiments, the lighter device (110) can further include a compass (132). According to one or more embodiments, the compass (132) glows in the dark.

Figure 3A:
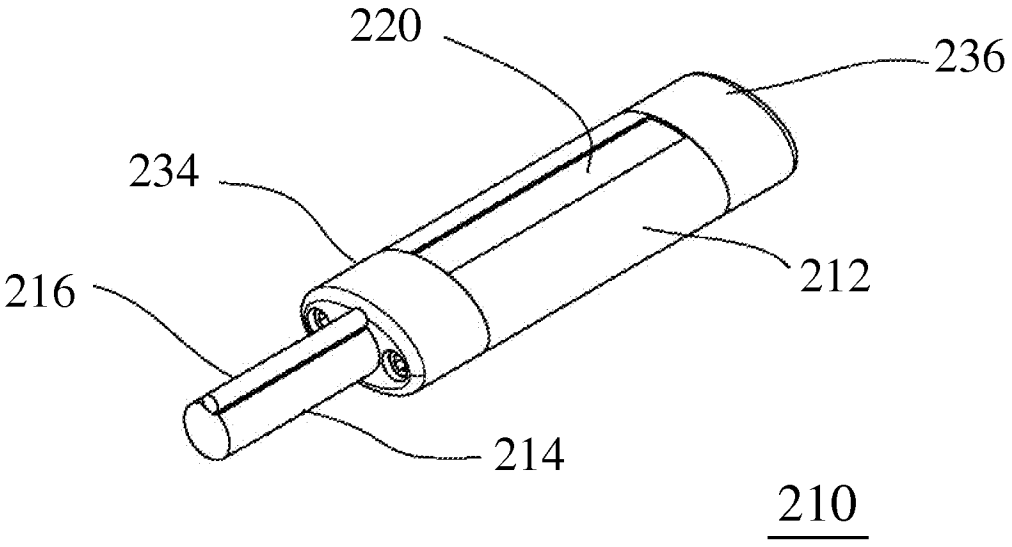
FIG. 3A is a perspective view of an example of a lighter device in accordance with embodiments of the present disclosure.
Figure 3B:
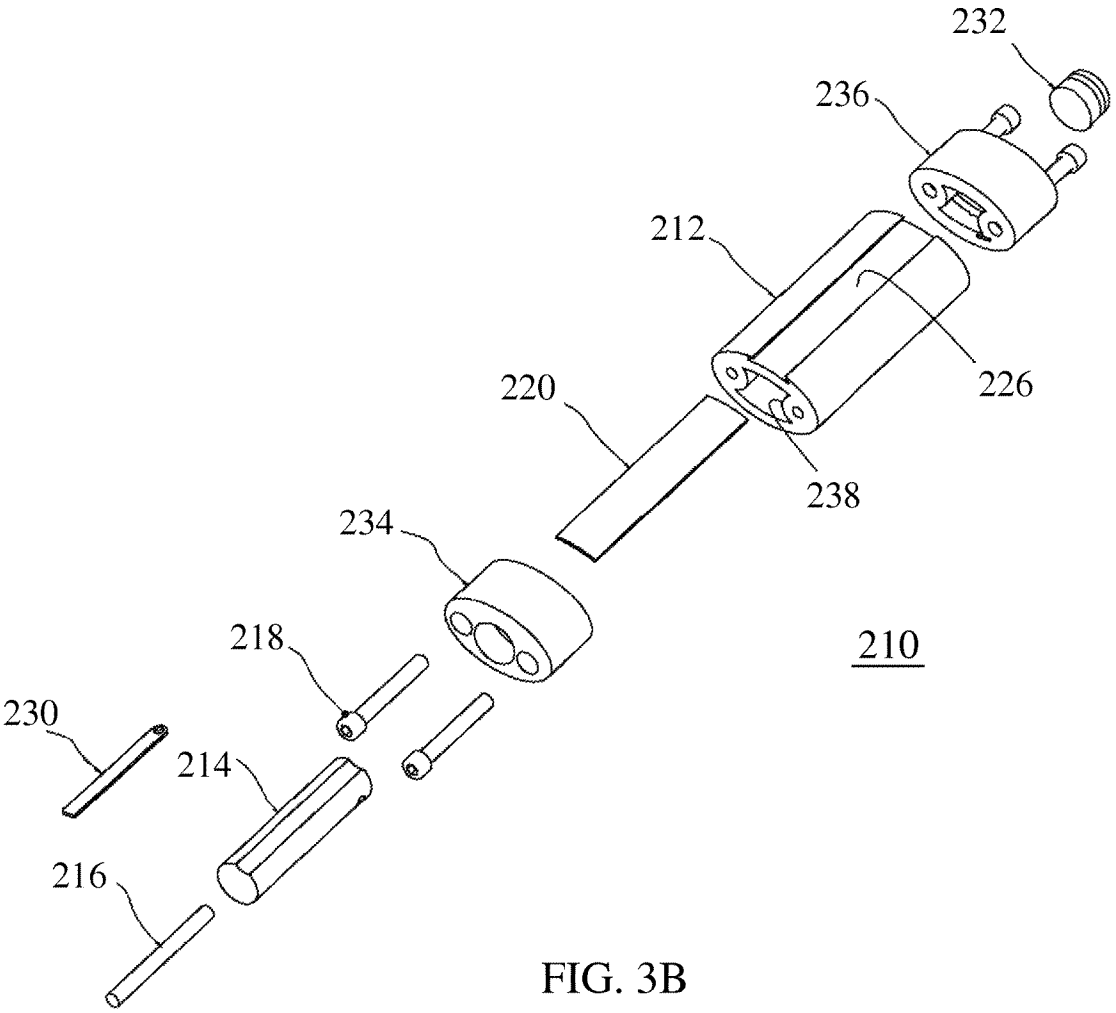
FIG. 3B is an exploded view of FIG. 3A.

FIG. 3A illustrates an example of a lighter device (210) having a mirror in accordance with embodiments of the present disclosure. FIG. 3B illustrates an exploded view of the lighter device of FIG. 3A. FIG. 3B illustrates the lighter device (210) comprising a handle (212) defining a slidejoint (226) that selectively receives a mirror (220). The handle (212) can include a polymer. The mirror (220) can be slideably received in the slidejoint (226). Accordingly, the mirror (220) can be slideably removed and reinserted, for example, to enable a person to use the mirror as a signaling device. The mirror (220) can be bendable to form a reflective parabolic surface that represents an improvement over a flat mirror to serve as a signaling device.

The lighter device (210) can include an ignitable material (214) carried by the handle (212) and a striker material (216) for igniting the ignitable material (214). The striker material can extend along a length of the ignitable material (214). The lighter device (210) can define a cavity (238). The cavity can include a battery pack to power one or more LED lights carried on the magnesium cap (234) that carries the ignitable material (214) and encloses the front end of the cavity (238). The compass cap (236) can enclose the rear end of the cavity (238). A gasket can be present between both the magnesium cap (234) and the compass cap (236) to seal the cavity. The magnesium cap (234), the compass cap (236) and the gaskets can be secured to the handle (212) with screws (218). The compass cap (236) can include a compass (232). The compass cap (236) can be easily removable and replaceable and the cavity (238) defined by the handle (212) can be useful for storing one or more items.

While the embodiments have been described in connection with the various embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A lighter comprising:

a combustible handle consisting of lignocellulosic material, a wax and a resin, the handle configured to form shavings when portions of the combustible handle are shaved;

an ignitable material carried by the handle and configured for shaving to form additional shavings;

a striker material carried by the handle and configured for striking to ignite the shavings and the additional shavings.

2. The lighter of claim 1, further comprising a mirror selectively carried by the handle, wherein the mirror is bendable to form a reflective parabolic surface.

3. The lighter of claim 1, further comprising a mirror selectively carried by the handle, wherein the handle defines a recess that selectively receives a mirror holder.

4. The lighter of claim 3, wherein the mirror is slideably received in the mirror holder.

5. The lighter of claim 1, further comprising a mirror selectively carried by the handle, wherein the handle defines a slidejoint that selectively receives the mirror.

6. The lighter of claim 5, wherein the mirror is slideably received in the slidejoint.

7. The lighter of claim 1, wherein the handle defines a pattern.

8. The lighter of claim 7, wherein the pattern is a camouflage design.

9. The lighter of claim 1, wherein the striker material is carried by the ignitable material.

10. The lighter of claim 9, wherein the striker material extends along a length of the ignitable material.

11. The lighter of claim 1, further comprising a striker bar for striking the striker material.

12. The lighter of claim 11, wherein the striker bar is configured for shaving portions of the ignitable material and/or the handle to form shavings and/or additional shavings.

13. The lighter of claim 1, wherein the striker material comprises a flint material having one or more dopants and/or colorants for effectuating colored sparks.

14. The lighter of claim 13, wherein the dopants and/or colorants comprise one or more of iron, phosphorus, barium, calcium salts, copper compounds, or strontium salts.

15. The lighter of claim 1, further comprising a compass.

16. The lighter of claim 1, wherein the ignitable material comprises magnesium.

17. The lighter of claim 16, wherein the magnesium comprises one or more dopants and/or colorants for burning hotter and effectuating colored flames.

18. The lighter of claim 17, wherein the dopants and/or colorants comprise one or more of iron, phosphorus, barium, calcium salts, copper compounds, or strontium salts.

19. The lighter of claim 1, wherein the handle defines a cavity for storing one or more items.

20. The lighter of claim 19, further comprising a cap for enclosing the cavity.

21. The lighter of claim 20, wherein the cap comprises a compass.

22. The lighter of claim 21, wherein the compass glows in the dark.

23. The lighter of claim 1, wherein the lighter is buoyant in water.

24. A method for igniting, comprising:

shaving off portions of a combustible handle to form shavings, the handle consisting of lignocellulosic material, a wax and a resin;

striking a striker material carried by the handle for igniting the shavings; and shaving off portions of an ignitable material carried by the handle to form additional shavings, wherein striking the striking material further ignites the additional shavings.

25. The method of claim 24, wherein the shaving and striking is performed using a striker bar tethered to the handle.

* * * * *